United States Patent [19]

Schoenberg

[11] Patent Number: 4,735,313

[45] Date of Patent: Apr. 5, 1988

[54] CARRIER FOR CANS

[76] Inventor: Kenneth Schoenberg, 5423 Red Fox, Brighton, Mich. 48116

[21] Appl. No.: 752,294

[22] Filed: Jul. 5, 1985

Related U.S. Application Data

[63] Continuation-in-part of Ser. No. 675,882, Nov. 28, 1984, abandoned.

[51] Int. Cl.[4] ..... B65D 65/00

[52] U.S. Cl. ..... 206/427; 221/309; 220/234; 220/94 A

[58] Field of Search ..... 206/430, 429, 427, 203, 206/201, 535, 536, 537; 221/307, 309, 310; 220/234, 94 A

[56] References Cited

U.S. PATENT DOCUMENTS

| | | | |
|---|---|---|---|
| 243,925 | 7/1881 | La Bau | 206/535 |
| 1,459,184 | 6/1923 | Morton | 206/430 |
| 2,122,003 | 6/1938 | Cooper | 221/307 |
| 3,409,193 | 11/1968 | Metcalf | 220/23.4 |
| 3,498,523 | 3/1970 | Stembridge | 206/203 |
| 3,595,435 | 7/1971 | Graham Jr. | 221/310 |
| 3,599,828 | 8/1971 | Conway | 220/23.4 |
| 3,957,174 | 5/1976 | Palamara | 221/309 |
| 4,042,156 | 8/1977 | Knight | 221/309 |
| 4,165,812 | 8/1979 | Jennison | 220/23.4 |
| 4,474,294 | 10/1984 | Koppelmans | 206/535 |
| 4,574,981 | 3/1986 | Jewett | 221/309 |

FOREIGN PATENT DOCUMENTS

| | | | |
|---|---|---|---|
| 1116567 | 1/1982 | Canada | 206/428 |
| 2423411 | 11/1979 | France | 220/94 A |
| 29243 | 11/1918 | Norway | 220/23.4 |

*Primary Examiner*—Joseph Man-Fu Moy

*Attorney, Agent, or Firm*—Gifford, Groh, VanOphem, Sheridan, Sprinkle and Dolgorukov

[57] ABSTRACT

The present invention provides a carrier for transporting and storing cylindrical cans. The carrier includes a plurality of elongated cylindrical tubes which are open at each end and have a longitudinally extending slot formed along their front. Each tube is dimensioned to slidably receive a can through its open top while a stop adjacent the bottom end of each tube retains the cans within the interior of the tube. The tubes are constructed of a resilient material so that, by grabbing and pulling a can from the bottom of a tube, the tube flexes outwardly and allows the can to pass past the stop and out of the bottom of the tube.

8 Claims, 2 Drawing Sheets

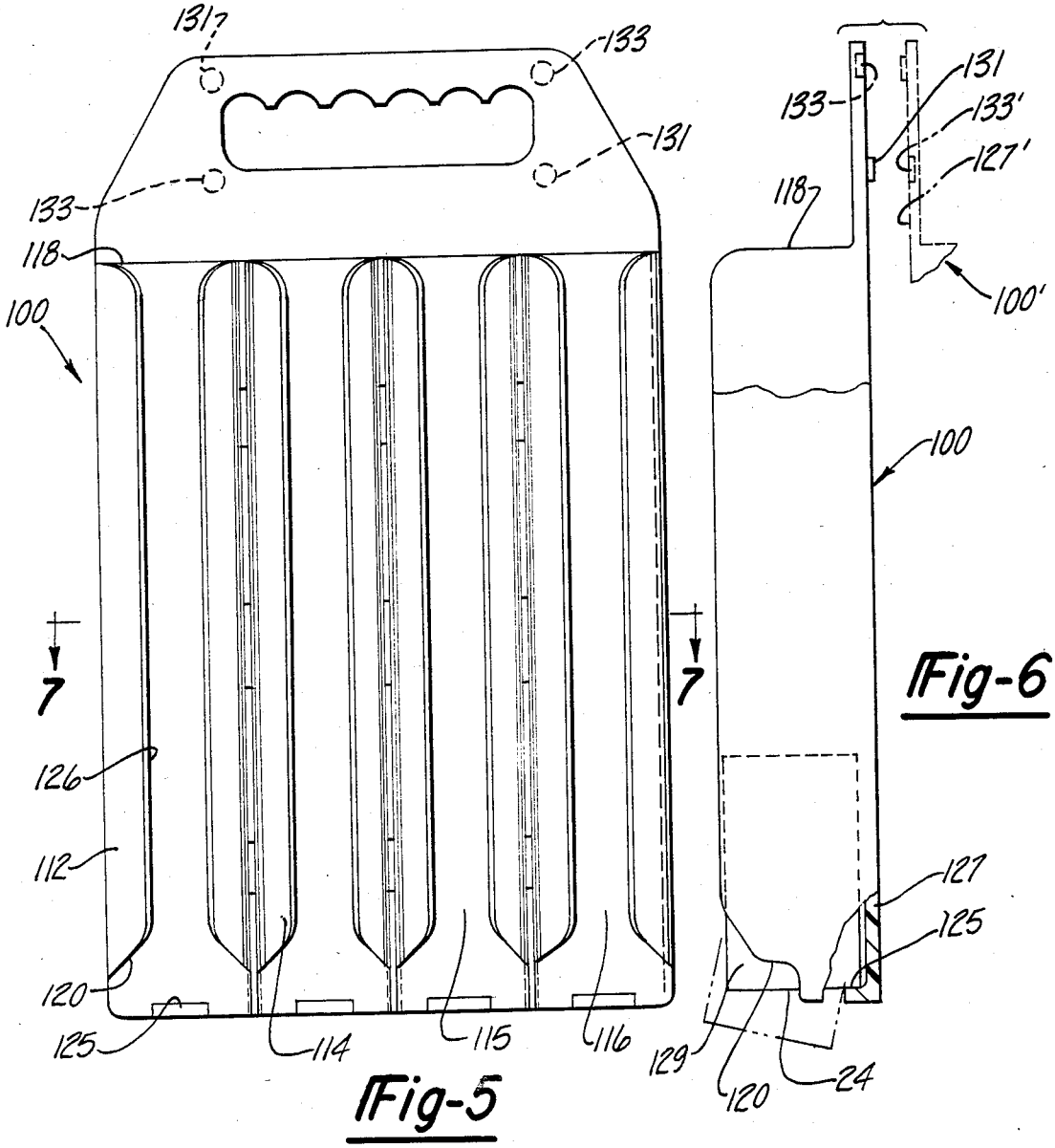
Fig-6
Fig-5
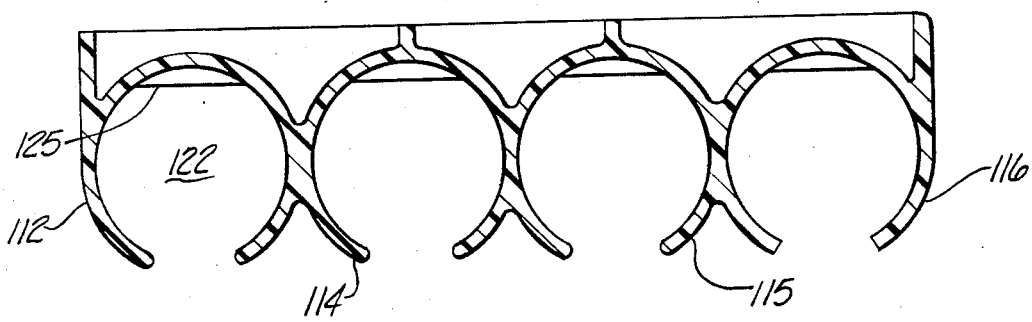
Fig-7

CARRIER FOR CANS

CROSS REFERENCE TO RELATED APPLICATIONS

This application is a continuation in part of U.S. Ser. No. 675,882, filed Nov. 28, 1984, and now abandoned entitled Carrier for Cans and naming Kenneth Schoenberg as inventor.

BACKGROUND OF THE INVENTION

I. Field of the Invention

The present invention relates generally to carriers and, more particularly, to a carrier for transporting and storing cylindrical cans.

II. Description of the Prior Art

Many states have enacted returnable bottle and can laws. In these states, the retailer of beverages sold in cans and bottles is required to obtain a deposit from the retail customer. This deposit is subsequently returned by the retailer to the customer when the empty bottle or can is returned to the store. Among other things, these laws are designated to minimize the highway litter and encourage resource conservation through recycling.

The return of bottles by the customer to the store has not represented much of a problem. Such bottles are typically sold in six or eight pack carriers when they are purchased from the store and these carriers serve as a convenient means for returning the empties to the store after consumption.

The return of empty cans by the consumer to the store, however, has presented a much greater problem. Such cans typically sold in six or eight packs in which the cans are held together by a flimsy plastic carrier which encircles the tops of the cans. Such plastic carriers are usually discarded after the beverage is consumed since reinsertion of the can into the carrier is difficult to accomplish and may be impossible to accomplish due to deformation of the carrier.

Consequently, the empty cans are typically returned to the store in plastic trash bags or the like which are both bulky and cumbersome to handle. Furthermore, since the retail stores will normally only accept empty cans for the brands of beverage carried by the store, it is necessary to unload the empty beverage cans singularly from the trash bag in the store so that the storekeeper can inspect them. This is not only tedius and time consuming, but also unsanitary.

SUMMARY OF THE PRESENT INVENTION

The present invention provides a carrier for transporting and storing cans, both empty and full, which overcomes all of the above mentioned disadvantages.

In brief, the carrier according to the present invention comprises a plurality of elongated cylindrical tubes each of which is open at its top or bottom. Each tube, furthermore, is dimensioned to slidably receive a plurality of cans within its interior so that the cans are in end to end abutment with each other.

In one form of the invention, in order to limit the travel of the cans within the tubes, each tube includes a flexible tab adjacent its bottom end which protrudes inwardly into the interior of the tube and abuts against the bottom of the first can inserted into the open top of the tube. Since the tab is flexible, however, the cans can be discharged through the bottom of the tube when desired by pushing downwardly on the cans which flexes the tab outwardly and releases the cans.

Each tube preferably includes an elongated slot which extends entirely from its top and to its bottom. This slot not only facilitates discharging the cans through the bottom of the tube, but also exposes a sufficient portion of each can so that the retailer can identify the brand name.

An inverted U-shaped handle is secured across the top of the tubes for transporting the carrier. In addition, the tubes, handles and tab are preferably of a one piece plastic construction.

In an alternate embodiment of the invention, the tab is replaced by a wall extending across the bottom of each tube. The first can inserted into the tube abuts against this wall so that the wall retains the cans within the tube. In this embodiment of the invention, in order to empty the cans from the tubes, the entire carrier is inverted so the cans discharge out of the top ends of the tubes.

In still a further preferred embodiment of the invention, a rigid stop tab protrudes into the interior of the tube adjacent its lower end. In order to remove cans from the tube, the can is grasped and pulled away from the stop tab which flexes the tube outwardly and allows the can to pass across the front of the stop tab and out through the bottom of the tube.

BRIEF DESCRIPTION OF THE DRAWING

A better understanding of the present invention will be had upon reference to the following detailed description, when read in conjunction with the accompanying drawing, wherein like reference characters refer to like parts throughout the several views and in which:

FIG. 5 is a front view illustrating a second preferred embodiment of the present invention;

FIG. 6 is a partial fragmentary side view illustrating the second preferred embodiment of the present invention; and FIG. 7 is a cross sectional view taken substantially along line 7—7 in FIG. 5.

DETAILED DESCRIPTION OF PREFERRED EMBODIMENTS OF THE INVENTION

Figure 1:
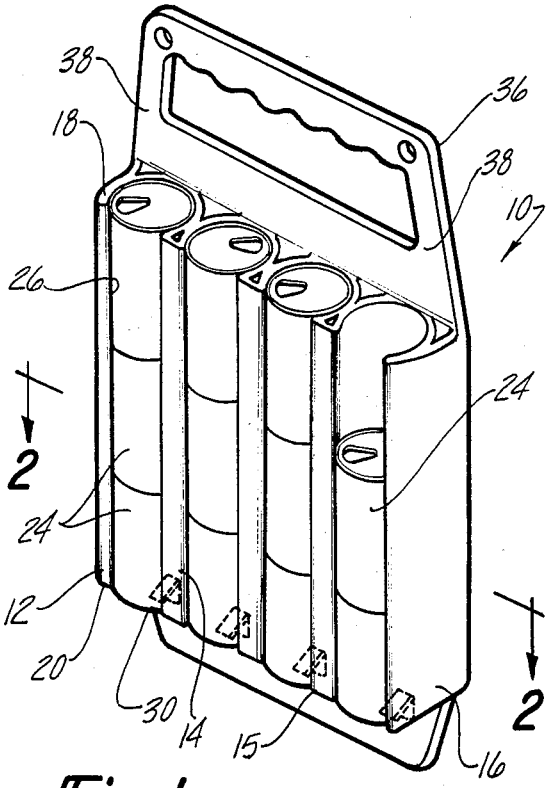
FIG. 1 is a perspective view illustrating a preferred embodiment of the present invention.
Figure 2:
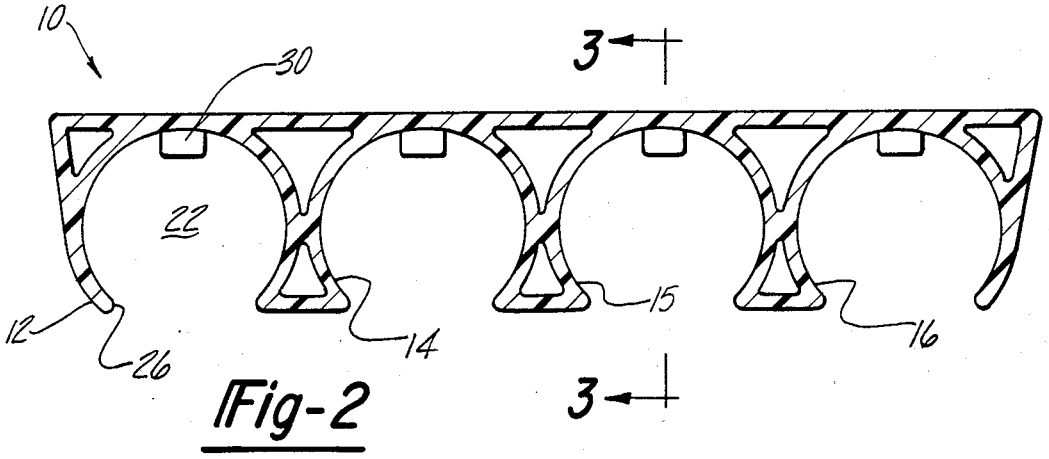
FIG. 2 is a sectional view taken substantially along line 2—2 in FIG. 1.

With reference first to FIGS. 1 and 2, a preferred embodiment of the carrier 10 of the present invention is thereshown and comprises at least two and preferably four elongated cylindrical tubes 12, 14, 15 and 16. Each tube 12, 14, 15 and 16 is substantially identical to each other so that only one tube 12 will be described in detail, it being understood that a like description shall also apply to the other tubes 14, 15 and 16.

Still referring to FIG. 1, the tube 12 is elongated and cylindrical having an open top 18, an open bottom 20 and defining an interior cylindrical chamber 22. This chamber 22 is dimensioned to receive a plurality of cans 24 (FIG. 1) in end to end abutment with each other wherein the cans 24 are conventional beverage cans. Furthermore, although the tube 12 is preferably dimensioned to receive three cans 24 within its interior 22, the tube 12 can be shorter or longer, and thus hold fewer or more cans 24, without deviation from the spirit or the scope of the invention.

An elongated slot 26 is formed axially along one side of the tube 12 from its top 18 and to its bottom 20. This slot 26 is of a sufficient width so that the brand name of the cans 24 contained within the interior 22 can be readily identified.

Figure 3:
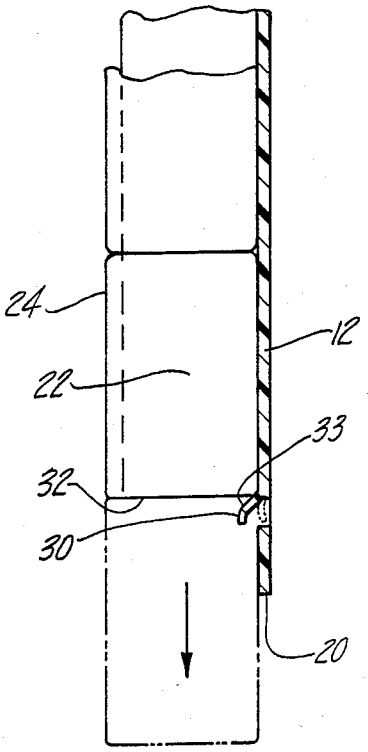
FIG. 3 is a fragmentary sectional view taken substantially along line 3—3 in FIG. 2.

With reference now to FIG. 1-3, in order to retain the cans 24 within the interior 22 of the tube 12, a tab 30 is formed along the rear side of the tube 12 adjacent its bottom 20. As best shown in FIG. 3, this tab 30 abuts against the bottom 32 of the first can 24 which is inserted through the open top 18 of the tube 22. The tab 30 thus limits the downward travel of the can 24 through the tube 12 and, in doing so, retains the cans 24 within the tube interior 22.

The tab 30, however, is movable from a first position, illustrated in solid line in FIG. 3 to a second position illustrated in phantom line in FIG. 3. The tab 30 is preferably made of a resilient material such as plastic, and is resiliently urged towards its first position. In its first position, the tab 30 retains the cans 24 within the tube 12 as described above. Conversely, as the tab 30 is moved away from the tube interior 22 to a retracted position, the tab 30 allows the cans 24 to be discharged through the bottom 20 of the tube 12 as shown in phantom line in FIG. 3. In order to move the tab 30 to its retracted position, the cans 24 are simply pushed downwardly along the slot 26 so that the coaction between the can 24 and a ramped surface 33 on the tab 30 pivots the tab 30 to its retracted position and allows the cans 24 to be discharged through the tube bottom 20. Other means, however, can be alternatively used to pivot the tab 30 to its retracted position.

With reference again to FIGS. 1 and 2, the tubes 12, 14, 15 and 16 are preferably coplanar with each other so that the tubes 14 and 15 are sandwiched in between the tubes 12 and 16. An inverted U-shaped handle 36 has its lower or free ends 38 secured to the top 18 of the tubes 12 and 16 so that the entire carrier 10 can be easily transported by hand.

In the preferred form of the invention, the entire carrier 10 is of a one piece plastic construction.

Figure 4:
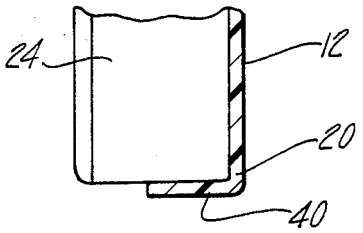
FIG. 4 is a fragmentary sectional view similar to FIG. 3 but showing a modification thereof.

With reference now to FIG. 4, a second preferred embodiment of the present invention is there shown in which the tab 30 (FIG. 2) is replaced by a wall 40 which extends across the bottom 20 of the tube 12. The first can 24 inserted into tube 12 abuts against the wall 40 so that the wall 40 retains the cans 24 within the tube 12. In order to remove the cans 24 from the tubes 12, 14, 15 and 16, the entire carrier 10 is simply inverted so that the cans 24 discharge out through the open top 18 of the tubes 12, 14, 15 and 16.

With reference now to FIGS. 5-6, a third preferred embodiment of the carrier 100 of the present invention is thereshown and comprises at least two and preferably four elongated cylindrical tubes 112, 114, 115 and 116. Each tube 112, 114, 115 and 116 is substantially identical to the other so that only one tube 112 will be described in detail, it being understood that a like description shall also apply to the other tubes 114, 115, and 116.

The tube 112 is elongated and cylindrical having an open top 118, an open bottom 120 and defining an interior cylindrical chamber 122 (FIG. 7). This chamber 122 is dimensioned to receive a plurality of conventional beverage cans 24 (FIG. 6) in end to end abutment with each other.

An elongated slot 126 is formed axially along a front side of the tube 112 from its top 118 to its bottom 120. This slot is of sufficient width so that the brand name of the can 24 contained within the interior 122 can be easily identified.

Still referring to FIGS. 5-7, a stop tab 125 protrudes from a back 127 of the carrier 100 and into the interior 122 of each tube 112, 115, 114 and 116 adjacent the bottom 120 of each tube. As best shown in FIG. 6, this stop tab 125 abuts against the bottom of the first can 24 inserted into the tube 112, 114, 115 or 116 and limits the downward travel of the can in the tube 112 and, in doing so, retains the can 24 within the carrier 100.

With reference now particularly to FIGS. 5 and 6, the open bottom 120 of each tube 112-116 is spaced upwardly from the stop tab 125 so that a lower portion 129 of the bottommost can 24 in the tube 112-116 is is accessible through the front of the tube 112-116. Furthermore, each tube 112-116 is constructed of a sufficiently resilient and flexible material so that the lower portion 129 of the can 24 can be grasped and pulled outwardly to the position shown in phantom line in FIG. 6 and, in doing so, enables the can 24 to pass forwardly across the stop tab 125 and out through the bottom of the tube 112-116.

With reference still to FIGS. 5 and 6, the back 127 of the carrier 100 is generally planer. In addition, at least one and preferably two projections 131 protrude outwardly from the back 127 of the carrier 100 while, similarly, two recesses 133 are also formed in the back 127 of the carrier 100. Furthermore, each recess 133 is dimensioned to slidably receive one projection 131 therein.

As best shown in FIG. 6, the projections 131 and recesses 133 allow two carrier 100 to be detachably secured together in a back to back relationship. More specifically, by turning a second carrier 100' so that its back 127' faces the back 127 of the first carrier 100, the projections 131 on one carrier 100 register with the recesses 133' on the other carrier 100' and vice versa. Thus, the projections 131 and recesses 133 detachably lock the two carriers together against relative movement with respect to each other.

From the foregoing, it can be seen that the present invention provides an inexpensive and totally effective carrier for transporting and storing cans such as empty beverage cans. The cans in the carrier not only can be rapidly identified through the tube slots 26 by the retailer, but can also be rapidly, simply and easily discharged from the carrier when desired.

Having described my invention, however, many modifications thereto will become apparent to those skilled in the art to which it pertains without deviation from the spirit of the invention as defined by the scope of the appended claims.

I claim:

1. A carrier for transporting and storing cylindrical cans comprising:

a plurality of elongated cylindrical tubes, each tube being open at one end and dimensioned to slidably receive a plurality of cans in end to end abutment with each other, said tubes being secured together in a side by side relationship, wherein a portion of each sidewall of each tube also forms a portion of the sidewall of any adjacent tube so that adjacent tubes share one common integrally connected sidewall, means adjacent the other end of each tube for limiting the travel of a first can inserted into said one end of said each tube to a predetermined position closely adjacent the other end of said each tube, and a handle for carrying said tubes wherein said limiting means comprises a stop tab protruding into the interior of each tube and adapted to abut against a bottom of a can, and wherein said tubes each include a cut out portion diametrically opposite said stop tab and a longitudinally extending slot extending into said cut out portion, said tube having a flexible sidewall portion adjacent said cutout portion, and wherein said flexible sidewall portion flexes outwardly away from said stop tab and away from said slot to thereby enable a can to pass across said stop and through the bottom of the tube wherein said carrier includes a substantially planar back, and means for detachably securing two carriers together in a bck to back relationship wherein said carrier is of a one piece construction.

2. The invention as defined in claim 1 wherein said slot extends entirely between said ends of each tube.

3. The invention as defined in claim 1 wherein said carrier is constructed of plastic.

4. The invention as defined in claim 1 wherein said cans are conventional beverage cans.

5. The invention as defined in claim 1 wherein said slot extends along the entire length of said tube.

6. The invention as defined in claim 1 wherein said detachable securing means comprises at least one protrusion extending outwardly from the back of the carrier and at least one recess formed on the back of said carrier, said recess being dimensioed to receive said protrusion, and said protrusion and said recess being positioned on the back of said carrier so that, with two carriers positioned in a back to back relationship, the protrusion on each carrier is slidably received within the recess on the other carrier.

7. The invention as defined in claim 6 and comprising at least two protrusions and at least two recesses on the back of the carrier.

8. The invention as defined in claim 1 wherein said plurality of tubes comprise at least four tubes, said tubes being coplanar.

* * * * *

UNITED STATES PATENT AND TRADEMARK OFFICE

CERTIFICATE OF CORRECTION

PATENT NO. : 4,735,313

DATED : April 5, 1988

INVENTOR(S) : Kenneth Schoenberg

It is certified that error appears in the above-identified patent and that said Letters Patent is hereby corrected as shown below:

Col. 1, line 49, delete "tedius" and insert --tedious--

Col. 2, line 33, delete "drawing" and insert --drawings--

Col. 3, line 46, delete "there shown" and insert --thereshown--

Col. 4, line 28, delete "planer" and insert --planar--

Col. 4, line 36, delete "carrier" and insert --carriers--

Col. 5, line 20, delete "bck" and insert --back--

Col. 6, line 11, delete "dimensioed" and insert --dimensioned-- line 21, delete "comprise" and insert --comprises--

Signed and Sealed this

Twentieth Day of September, 1988

*Attest:*

*Attesting Officer*

DONALD J. QUIGG

*Commissioner of Patents and Trademarks*